US005253386A

United States Patent [19]

LaLonde

[11] Patent Number: 5,253,386

[45] Date of Patent: Oct. 19, 1993

[54] BRUSH FOR CLEANING INTERIOR OF A TUBE OR THE LIKE

[76] Inventor: Anthony F. LaLonde, 2469 Klein Rd., San Jose, Calif. 95148

[21] Appl. No.: 733,372

[22] Filed: Jul. 22, 1991

Related U.S. Application Data

[63] Continuation of Ser. No. 545,699, Jun. 28, 1990, abandoned.

[51] Int. Cl.[5] ..... A46B 3/18

[52] U.S. Cl. ..... 15/206; 15/104.2; 15/164

[58] Field of Search ..... 15/206, 104.2, 104.33, 15/106, 160

[56] References Cited

U.S. PATENT DOCUMENTS

| | | | |
|---|---|---|---|
| 750,357 | 1/1904 | Gibbons | 15/104.2 |
| 1,154,369 | 9/1915 | Browning | 15/104.2 |
| 1,421,529 | 7/1922 | Millhouse | 15/160 |
| 2,272,419 | 2/1942 | Meyer | 15/164 |
| 2,290,534 | 7/1942 | Cave | 15/160 |
| 2,728,929 | 1/1956 | Bell | 15/160 |
| 2,895,155 | 7/1959 | Peterson | 15/192 |
| 2,897,525 | 8/1959 | Goodwin et al. | 15/104.2 |
| 3,085,272 | 3/1961 | Weichselbaum | 15/164 |
| 3,133,298 | 5/1964 | Norwood | 15/164 |
| 3,151,517 | 4/1963 | Guinness | 84/330 |
| 3,296,644 | 1/1967 | Weisberg | 15/206 |
| 3,591,885 | 7/1971 | Fritzen | 15/143 R |
| 3,739,420 | 6/1973 | Kafkis | 15/211 |
| 4,030,199 | 6/1977 | Russell | 15/206 |
| 4,108,162 | 8/1978 | Chikashige et al. | 15/206 |
| 4,114,504 | 9/1978 | Koregelos | 84/453 |
| 4,387,479 | 6/1983 | Kigyos | 15/206 |
| 4,395,943 | 8/1983 | Brandli | 15/167 |
| 4,407,182 | 10/1983 | Biasini | 84/453 |
| 4,691,404 | 9/1987 | Tarrson et al. | 15/206 |
| 4,819,291 | 4/1989 | Gunjian | 15/160 |

FOREIGN PATENT DOCUMENTS

| | | | |
|---|---|---|---|
| 671738 | 9/1929 | France | 15/206 |
| 818278 | 8/1959 | United Kingdom | 15/104.2 |

*Primary Examiner*—Harvey C. Hornsby
*Assistant Examiner*—Patrick F. Brinson
*Attorney, Agent, or Firm*—Jack M. Wiseman

[57] ABSTRACT

A brush for a hollow structure with an open end includes brush bristles secured to a twisted wire. In one embodiment, a non-abrasive, heat-shrinking plastic tube is slip-fitted over the twisted wire at a section thereof that is free of brush bristles. The heat-shrinking plastic tube is heat-shrunk to form a tight fit with the twisted wire to form a brush handle therewith. In another embodiment, a non-abrasive solid cylindrical body is penetrated along the axis or center line thereof by a section of twisted wire that is free of brush bristles.

4 Claims, 1 Drawing Sheet

BRUSH FOR CLEANING INTERIOR OF A TUBE OR THE LIKE

This is a continuation of copending application Ser. No. 07/545,699 filed on Jun. 28, 1990, now abandoned.

BACKGROUND OF THE INVENTION

The present invention relates in general to brushes, and more particularly to brushes for cleaning the interior of a tubular structure or the like.

The playing of musical instruments causes foreign substances to collect on the inner wall of the mouthpiece, the valves and the tubes of the wind instrument. It is caused by the breath of the instrumentalist collecting on the inner wall of the mouthpiece, the valves and the tubes of the wind instrument. Proper care of the wind instrument requires removal of the foreign substances from the mouthpiece, the valves and the tubes of the wind instrument.

Heretofore, the mouthpiece of the wind instrument was cleaned by a bristle brush having tapered bristles secured to a twisted wire handle. The valves of the wind instrument were cleaned by a bristle brush having bristles forming a cylindrical configuration. Brushes for the cleaning of the tubes of wind instruments were heretofore constructed from steel coiled wire connected to twisted wires with bristles secured to the free ends of the twisted wires. A sheath surrounded the steel coiled wire. Such coiled wire brushes would kink while in use. As a consequence of the kinking of the coiled wire brushes, the coiled wire brushes would lodge in the musical wind instrument and were difficult to remove from the tube. Such coiled wire brushes had the tendency not only to lodge within a tube, but also the steel coiled wire had a tendency to scratch the inner lacquer surface of the tube. Additionally, steel coiled wire had a tendency to oxidize and rust.

The U.S. Pat. to Peterson, No. 2,895,155, issued on Jul. 21, 1959, for Wire Stem Brush, discloses the wire stem of a wire stem brush coated with an elastomeric sheath. The elastomeric sheath is extruded on the wire stem or may be applied by means of a latex dip.

In the U.S. Pat. to Brandli, No. 4,395,943, granted on Aug. 2, 1983, for Interproximal Toothbrush, discloses a toothbrush with a wire stem. The wire stem is enclosed by a nylon or polyurethane material. The nylon or polyurethane material is applied to the wire stem by dipping or spraying. In the alternative, the nylon or polyurethane material may be in the form of a tube drawn over the wire.

In the U.S. Pat. to Weisberg, No. 3,296,644, issued on Jan. 10, 1967, for Wire Core Back Brush Assembly, there is disclosed two wire core brushes secured together by a flexible link. The link is made of flexible plastic material, such as nylon.

The U.S. Pat. to Norwood, No. 3,133,298, issued on May 19, 1964, for Plastic Brush For Washing Inside Of Bottles, discloses a nylon plastic body. Nylon bristles protrude radially and outwardly from the nylon plastic body.

In the U.S. Pat. to Weichselbaum, No. 3,085,272, issued on Apr. 16, 1963, for Test Tube Brushes, there is disclosed a test tube brush molded from a synthetic resin, such as polyethylene, polypropylene, polyvinyl acetate or similar resilient rubber-like material. The handle includes a stem from which scrubbing fingers project.

The U.S. Pat. to Kafkis, No. 3,739,420, granted on Jun. 19, 1973, for Device For Swabbing The Bore Of A Musical Instrument, discloses a polyurethane body. A cover sheet, such as a chamois, is disposed on the body for absorbing moisture. A flexible nylon cord is attached to the body for pulling the device through the bore of a musical instrument.

The U.S. Pat. to Koregelos, No. 4,114,504, issued on Sep. 19, 1978, for Demoisturizer For Wind Musical Instruments discloses a device for removing excess moisture from a wind instrument. The device includes an elongated member made of twisted wire. In the alternative, the elongated member may be made of plastic or wood.

The U.S. Pat. to Biasini, No. 4,407,182, granted on Oct. 4, 1983, for Musical Instrument Stand, discloses a musical instrument stand having a post secured to a base. The free end of the post projects into the interior of the musical instrument. The U.S. Pat. to Guinness, No. 3,151,517, issued on Oct. 6, 1964, for Musical Pipes, discloses a swab for musical pipes. The swab cleans the pipes and has a string for removing the swab.

In the U.S. Pat. to Millhouse, No. 1,421,529, issued on Jul. 4, 1922, for Cleaning Device, there is disclosed a cleaning device for wind instruments. The device comprises a closely wound spiral spring wire. Bristles are attached to a free end of the coiled wire by placing the bristles between pieces of soft wire and twisting the same together. One end of the twisted wire is wrapped with thread and screwed into the bore of the coiled wire.

SUMMARY OF THE INVENTION

A brush for cleaning the interior of an open-ended hollow structure in which brush bristles are secured to a wire. A section of the wire is free of brush bristles. The section of the wire free of brush bristles penetrates a solid non-abrasive, plastic cylindrical body to form a handle for the brush.

A brush for cleaning the interior of an open-ended hollow structure in which brush bristles are secured between a metallic member having a section thereof free of brush bristles. The section of the metallic member free of brush bristles is embraced by a non-abrasive, heat-shrinking plastic tube to form a handle for the brush.

A brush for cleaning the interior of an open-ended hollow structure in which brush bristles are secured between turns of twisted wire having a section thereof free of brush bristles.

The section of the twisted wire free of brush bristles is spaced apart in segmented relation and surrounded by a non-abrasive plastic cylindrical body to form a handle for the brush. The plastic cylindrical body surrounds the segmented section of the twisted wire and the space therebetween.

An object of the present invention is to provide a brush for cleaning the interior of an open-ended hollow structure which is economical to manufacture and yet has greater durability.

Another object of the present invention is to provide a brush for cleaning the interior of an open-ended hollow structure which does not kink, stretch out of shape, lodge within the hollow structure, reduce the wear of the hollow structure, scratch or otherwise deface the hollow structure, or impair the intended function of the hollow structure.

A feature of the present invention is that the non-abrasive heat-shrinking plastic tube is adaptable for slip-fitting over the member joined thereto for facilitating the connection therewith.

DETAILED DESCRIPTION OF THE PREFERRED EMBODIMENTS

Figure 1:
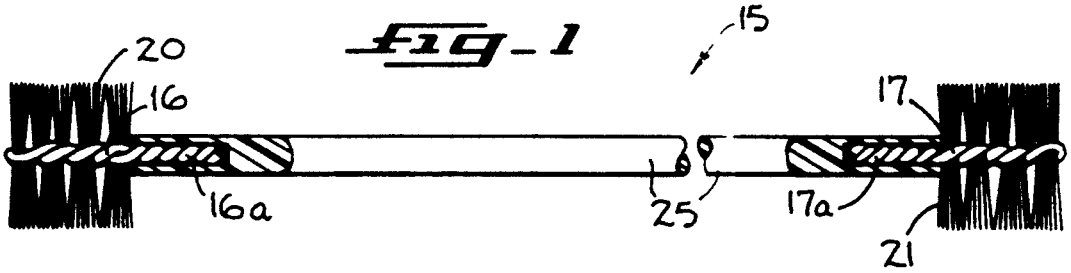
FIG. 1 is a fragmentary elevation view of a brush embodying the present invention partially in section to illustrate the construction of the handle thereof.
Figure 1A:
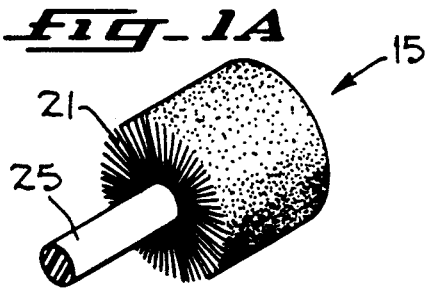
FIG. 1A is a fragmentary perspective view of one end of the brush shown in FIG. 1.

Illustrated in FIGS. 1 and 1A is a brush 15 comprising, in the exemplary embodiment, twisted wires 16 and 17 at opposite ends thereof. The wires 16 and 17 are made of steel and are, respectively, approximately 0.017 of an inch in diameter. In the exemplary embodiment, the twisted wires 16 and 17 are made of galvanized steel. Secured between the turns of the twisted wires 16 and 17 in a well-known manner are suitable brush bristles 20 and 21, respectively. The brush bristles 20 and 21 project radially outwardly from the wires 16 and 17, respectively. The wires 16 and 17 include bristle free sections **16*a* and 17*a***, respectively.

Interconnecting the bristle free sections of the twisted wires 16 and 17, respectively, is a flexible, non-abrasive, plastic cylindrical body 25. In the preferred embodiment, the cylindrical body 25 is initially a solid cylindrical body and is made of high density polypropylene or nylon. In the exemplary embodiment, the cylindrical body 25 has a diameter of approximately 0.156 of an inch. The polypropylene and the nylon cylindrical body are well-known material and can be acquired from plastic distributors. The solid cylindrical body 25 serves as a handle for the brush 15.

In the preferred embodiment, the solid cylindrical body 25 receives at the opposite free ends thereof the bristle free end sections **16*a* and 17*a*, respectively, of the twisted wires 16 and 17. Toward this end, a drill-like tool is stationarily disposed on a support structure. A rotatable shaft is driven by an electric motor in a well-known manner. At the free end of the rotatable shaft is a suitable drill block for rotation therewith. The drill block receives the end of the twisted wire to which the brush bristles are secured for rotating the twisted wire. The bristle free end of the twisted wire rotates with the drill block. An operator urges one free end of the solid cylindrical body 25 against the rotating bristle free end of the twisted wire so that the bristle free end of the twisted wire penetrates one free end of the cylindrical body 25. The penetration by the bristle free end of the twisted wire is along the axis or center line of the cylindrical body 25. This results in the bristle free end of the twisted wire being fixedly secured to one end of the cylindrical body 25**.

A similar procedure is followed for fixedly securing the bristle free end of another twisted wire to the opposite end of the cylindrical body 25. The twisted wire secured to the cylindrical body 25 is removed from the drill-like tool. Now, another twisted wire is inserted into the drill block for rotation therewith with the bristle free end thereof projecting outwardly from the drill block. The opposite free end of the cylindrical body 25 is now urged against the bristle free end of the other twisted wire so that the bristle free end of the other twisted wire penetrates the opposite free end of the cylindrical body 25 along the axis or center line of the cylindrical body 25. This results in the bristle free end of the twisted wire being fixedly secured to the opposite end of the cylindrical body 25.

Should it be desired to further secure, respectively, the bristle free sections **16*a* and 17*a* of the twisted wires 16 and 17 to the opposite ends of the cylindrical body 25, a suitable adhesive or epoxy resin, such as Loctite No. 460, is applied to the bristle free end of the twisted wire while the twisted wire is penetrating the cylindrical body 25**.

The brush 15 is commonly referred to as a snake brush and it is suitable for the cleaning of tubular structures such as the tubes in musical wind instruments, the bore of rifles and the like. The brush 15 is capable of cleaning foreign matter from hollow structures with an open end without defacing or scratching the interior walls of the structure. There is no tendency to kink or remain lodged within tubes that are curved, such as found in various musical instruments. It has been found that the brush 15 is sufficiently flexible so as to follow the contour of curved tubular structures and particularly tubular structures having turns in excess of 180 degrees.

Figure 2A:
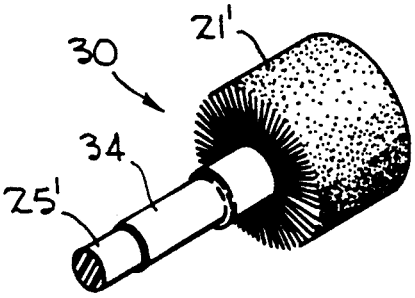
FIG. 2A is a fragmentary perspective view of one end of the brush shown in FIG. 2.
Figure 2:
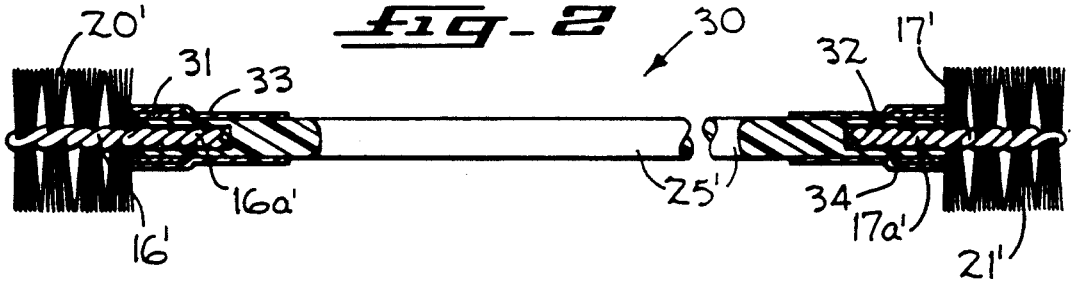
FIG. 2 is a fragmentary elevation view of a modification of the brush shown in FIG. 1 partially in section to illustrate the construction of the handle thereof.

Illustrated in FIGS. 2 and 2A is a brush 30, which is a modification of the brush 15 shown in FIGS. 1 and 1A. Therefore, parts of the brush 30 similar to the parts of the brush 15 will have the same reference numeral, but with a prime suffix.

The brush 30 differs from the brush 15 in that suitable metallic sleeves 31 and 32, such as steel sleeves, are crimped or tightly fitted, respectively, over sections of the cylindrical body 25' in which the bristle free ends **16*a*' and 17*a*' of the twisted wires 16 and 17 penetrate. The metallic sleeves 31 and 32 are contiguous to the adjacent ends of the bristles 20' and 21'**, respectively.

Enveloping and embracing the sleeves 31 and 32, respectively, are suitable plastic sheaths 33 and 34. The plastic sheaths 33 and 34 extend, respectively, from the adjacent ends of the bristles 20' and 21' onto the sleeves 31 and 32, respectively, and onto the adjacent sections of the cylindrical body 25'.

A suitable adhesive or epoxy resin, such as Loctite No. 460, is interposed between the sheaths 33 and 34 and the sleeves 31 and 32, respectively, and the respective confronting sections of the cylindrical body 25'. The curing of the adhesive or epoxy resin additionally secures the ends of the cylindrical body 25' and the confronting bristle free ends **16*a*' and 17*a*' of the twisted wires 16' and 17'** in a tight fitting and durable arrangement to form secure joints therebetween.

Figure 3A:
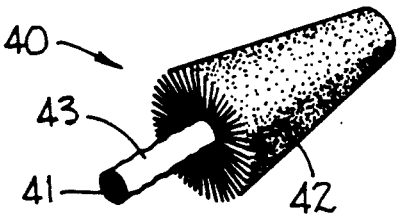
FIG. 3A is a fragmentary perspective view of the brush end of the brush shown in FIG. 3.
Figure 3:
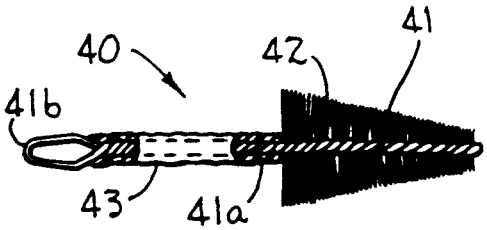
FIG. 3 is an elevation view of a single bristle end of a brush embodying the present invention partially in section to illustrate the construction of the handle thereof.

Illustrated in FIGS. 3 and 3A is a brush 40 comprising a twisted wire 41. The twisted wire 41 is made of galvanized steel and is approximately 0.017 of an inch in diameter. Secured between the turns of the twisted wire 41, in a well-known manner, are suitable brush bristles 42. The brush bristles 42 project radially outwardly from the twisted wire 41 and, in the exemplary embodiment, the brush bristles taper toward the free end thereof. The twisted wire 41 includes a bristle free section 41*a*.

A non-abrasive, heat-shrinking plastic tube 43 slip-fits over the bristle free section 41*a* of the twisted wire 41. The plastic tube 43 is then heated for heat-shrinking in a well-known manner. In so doing, the plastic tube 43, after being subjected to heat shrinking, envelopes and embraces the bristle free section 41*a* of the twisted wire 41 in a tight fit. At the free end of the twisted wire 41 is formed a loop 41*b* of greater dimension than the diameter of the bristle free section 41*a*. The plastic tube 43, the bristle free section 41*a* of the twisted wire 41 and the loop 41*b* form a handle for the brush 40. The plastic tube 43, before heat shrinking, is approximately 0.187 of an inch in diameter. Suitable heat-shrinking plastic tubes are well known in the plastic art.

In heat shrinking the plastic tube 43, conventional heating devices may be employed. A shield is secured to the conventional heating device at the mouth of the heating tube to direct excessive heat away from the brush bristles and to protect the brush bristles. The shield is merely an angular disposed arcuate metallic plate, such as steel, that is disposed between the heating tube and the exposed brush bristles.

The tapered brush 40 is suitable for the cleaning of the interior of the mouthpiece of musical instruments, such as clarinets, alto saxophones and the like. The brush 40 cleans the interior of such mouthpieces without defacing or scratching the inner wall of the mouthpiece.

Figure 4A:
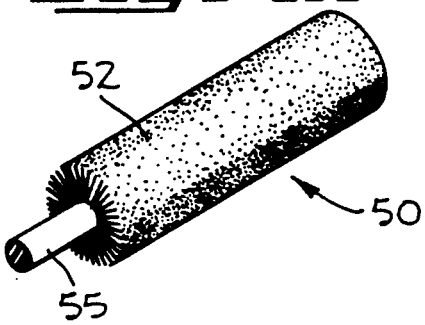
FIG. 4A is a fragmentary perspective view of the brush end of the brush shown in FIG. 4.
Figure 4:
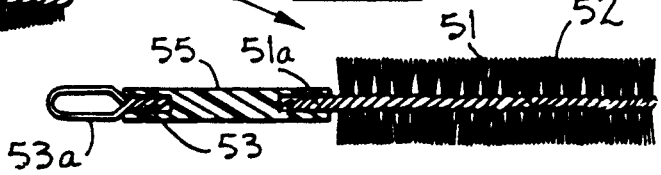
FIG. 4 is an elevation view of another brush having a single bristle end embodying the present invention.

Illustrated in FIGS. 4 and 4A is a brush 50 comprising, in the preferred embodiment, a twisted wire 51. The twisted wire 51, in the exemplary embodiment, is made of steel and is approximately 0.017 of an inch in diameter. Secured between the turns of the twisted wire 51, in a well-known manner, are suitable brush bristles 52. The brush bristles 52 project radially outward from the twisted wire 51. The twisted wire 51 includes a bristle free section 51A.

Spaced from the twisted wire 51 in the axial direction thereof is a twisted wire 53. The twisted wires 51 and 53 are disposed in a spaced, segmented relationship. At the free end of the twisted wire 53 is formed a loop 53*a* of greater dimension that the diameter of the twisted wire 53. In the exemplary embodiment, the twisted wire 53 is made of galvanized steel and is approximately 0.017 of a inch in diameter.

Interconnecting the bristle free section 51*a* of the twisted wire 51 and the confronting end of the twisted wire 53 is a flexible, non-abrasive plastic cylindrical body 55. In the preferred embodiment, the cylindrical body 55 is initially a solid cylindrical body and is made of high density polypropylene or nylon. In the exemplary embodiment, the cylindrical body 55 has a diameter of approximately 0.187 of an inch. The polypropylene and nylon cylindrical bodies are well-known material and can be acquired from plastic distributors. The solid cylindrical body 55, the twisted wire 53 and the bristle free section of the twisted wire 51 serve as a handle for the brush 50.

In the preferred embodiment, the solid cylindrical body 55 receives at the opposite free ends thereof, the twisted wire 53 and the bristle free section 51*a* of the twisted wire 51, respectively. Toward this end, a drill-like tool is stationarily disposed on a support structure. A rotatable shaft is driven by an electric motor in a well-known manner. At the free end of the rotatable shaft is a suitable drill block for rotation therewith. The drill block receives the handle 53*a* of the twisted wire 53 for rotating the twisted wire 53. The free end of the twisted wire 53 rotates with the drill block. An operator uses one free end of the solid cylindrical body 55 against the rotating free end of the twisted wire 53 so that the free end of the twisted wire 53 penetrates one free end of the cylindrical body 55. The penetration by the free end of the twisted wire 53 is along the axis or center line of the cylindrical body 25. This results in the twisted wire 53 being fixedly secured to one end of the cylindrical body 25.

The handle 53*a* is removed from the drill block. A similar procedure is followed for fixedly securing the bristle free end 51*a* of the twisted wire 51 to the opposite end of the cylindrical body 25. The twisted wire 51 is inserted into the drill block for rotation therewith with the bristle free end 51*a* thereof projecting outwardly from the drill block. The opposite free end of the cylindrical body 55 is urged against the bristle free end 51*a* of the twisted wire 51 so that the bristle free end 51*a* of the twisted wire 51 penetrates the opposite free end of the cylindrical body 55 along the axis or center line of the cylindrical body 55. This results in the bristle free end 51*a* of the twisted wire 51 being fixedly secured to the opposite end of the cylindrical body 55.

Should it be desired to further secure, respectively, the twisted wire 53 and the bristle free section 51*a* of the twisted wire 51 to the opposite ends of the cylindrical body 55, a suitable adhesive or epoxy resin, such as Loctite No. 460, is applied to the twisted wire 53 and the bristle free end 51*a* of the twisted wire 51 while the twisted wires 51 and 53 are penetrating the cylindrical body 55.

The brush 50, in the exemplary embodiment, has a cylindrical configuration for the brush bristles 52. The cylindrical configuration makes the brush 50 particularly suitable for cleaning the interior of the valves of musical wind instruments without defacing or scratching the inner wall of such valves.

I claim:

1. A brush for cleaning the interior of an open-ended hollow member comprising:

(a) wire means having a section for the securement of brush bristles and a section thereof free of brush bristles;

(b) a group of brush bristles secured to said wire means at the section thereof for the securement of brush bristles; and (c) a solid, flexible, non-abrasive, plastic cylindrical body surrounding and embracing said section of said wire means free of brush bristles along substantially the entire length thereof to protect the interior of an open-ended hollow member against marring by the brush and secured to said wire means for forming a handle for said brush, said solid cylindrical body being pierced and penetrated along the center line thereof at one end thereof by the section of said wire means free of brush bristles, said solid cylindrical body being flexible along substantially the entire length thereof.

2. A brush as claimed in claim 1 wherein said wire means is twisted at the section thereof for the securement of brush bristles to secure said group of brush bristles thereto by the turns thereof and is twisted at the section thereof free of brush bristles for the piercing and penetrating of said solid cylindrical body.

3. A brush as claimed in claim 1 and comprising another wire means spaced from said first-mentioned wire means, said other wire means having a section thereof for the securement of brush bristles and a section thereof free of brush bristles, another group of brush bristles secured to said other wire means at the section thereof for the securement of brush bristles, said solid cylindrical body being pierced and penetrated along the center line thereof by said section of said other wire means free of brush bristles at the end thereof opposite from said one end, said solid cylindrical body surrounding and embracing said section of said other wire means free of brush bristles along substantially the entire length thereof to protect the interior of the open-ended hollow member against marring by said brush.

4. A brush as claimed in claim 1 and comprising another twisted wire means spaced from said first-mentioned twisted wire means, said other twisted wire means having a section thereof for the securement of brush bristles and a section thereof free of brush bristles, another group of brush bristles secured to said other twisted wire means at the section thereof for the securement of brush bristles by the turns of said other twisted wire means, said solid cylindrical body being pierced and penetrated along the center line thereof by said section of said other twisted wire means free of brush bristles at the end thereof opposite from said one end, said solid cylindrical body surrounding and embracing said section of said other twisted wire means free of brush bristles along substantially the entire length thereof to protect the interior of the open-ended hollow member against marring by said brush.

* * * * *